US005615627A

United States Patent [19]

Marr, Jr.

[11] Patent Number: 5,615,627

[45] Date of Patent: Apr. 1, 1997

[54] METHOD AND APPARATUS FOR DESTRUCTION OF WASTE BY THERMAL SCISSION AND CHEMICAL RECOMBINATION

[75] Inventor: Andrew W. Marr, Jr., Ardmore, Okla.

[73] Assignee: BioCon, Incorporated, Oklahoma City, Okla.

[21] Appl. No.: 392,572

[22] Filed: Feb. 23, 1995

[51] Int. Cl.[6] ..... F23G 5/00; F23G 5/10

[52] U.S. Cl. ..... 110/346; 110/250; 110/236; 219/68

[58] Field of Search ..... 110/250, 346, 110/242, 237, 345; 219/68

[56] References Cited

U.S. PATENT DOCUMENTS

| | | | |
|---|---|---|---|
| 3,503,347 | 3/1970 | Marr, Jr. et al. | 110/250 X |
| 3,812,620 | 5/1974 | Titus et al. | 48/65 |
| 4,431,612 | 2/1984 | Bell et al. | 422/186.21 |
| 4,479,443 | 10/1984 | Faldt et al. | 110/346 |
| 4,655,968 | 4/1987 | Queiser et al. | 110/250 X |
| 5,134,946 | 8/1992 | Poovey | 110/346 |
| 5,364,447 | 11/1994 | Philipp et al. | 75/500 |

*Primary Examiner*—Henry A. Bennett
*Assistant Examiner*—Susanne C. Tinker
*Attorney, Agent, or Firm*—Dunlap & Codding, PC

[57] ABSTRACT

An apparatus having a thermal scission reactor with a graphite-lined plasma arc chamber for the pyrolytic disposal of toxic or hazardous waste. The thermal scission reactor includes a vessel with the plasma arc chamber surrounded by a water jacket. A tubular plasma arc electrode is provided for reciprocating movement within the plasma arc chamber. A conduit communicates with the tubular plasma arc electrode for the introduction of waste material through the tubular plasma arc electrode into the plasma arc chamber. The tubular plasma arc and an opposing electrode produce a plasma electric arc within the plasma arc chamber. An entry duct communicates with the plasma arc chamber for introduction of solid waste into the plasma arc chamber. An exit duct communicates with the plasma arc chamber for escape of gases and ash from the plasma arc chamber. Graphite liners are provided in the plasma arc chamber, the entry duct and the exit duct. The graphite liners may be impregnated with substances for neutralizing the waste material being processed. Injection ports for introduction of neutralizing agents, water, oxygen or hydrogen into the plasma arc chamber may be provided.

20 Claims, 5 Drawing Sheets

METHOD AND APPARATUS FOR DESTRUCTION OF WASTE BY THERMAL SCISSION AND CHEMICAL RECOMBINATION

BACKGROUND OF THE INVENTION

1. Field of the Invention

The present invention relates generally to the destruction of waste material and more particularly, but not by way of limitation, to the disposal of toxic, radioactive and hazardous wastes and poison gas streams through thermal scission of compounds and chemical recombination of molecules.

2. Description of Related Art

A number of methods for disposing of toxic or hazardous wastes are known in the art. Waste disposal systems using chemical detoxification, incineration and pyrolytic destruction have achieved varying degrees of success.

By virtue of extremely high temperatures, pyrolytic destruction is capable of breaking down even very stable molecules of waste material. A pyrolytic system is disclosed in U.S. Pat. No. 4,644,877, issued to. Barton et al. In the Barton system, waste is fed into a plasma arc burner, and then discharged into a reaction chamber to be cooled and recombined into products of gas and particulate matter. The recombined products are passed through a spray ring, which quenches and neutralizes the recombined products with an alkaline spray.

Another pyrolytic system is disclosed in U.S. Patent No. 4,509,434, issued to Boday et al. In this system, fluid waste is atomized by a plasma burner and water is introduced into the plasma to promote the formation of hydrogen halogenides if the waste material contains halogens. Atomized gases are then deacidified and washed.

Yet another system employing plasma pyrolysis is disclosed in U.S. Pat. No. 4,886,001, issued to Chang et al. In the Chang system, a mixture of waste and water is injected into a plasma torch to produce product gases and particulate. The product gases are sprayed in a scrubber with a caustic solution to neutralize the acidity of the product gases.

In each of these systems, the products of pyrolysis are neutralized after exiting the plasma arc vessel. Further, the products in these systems are neutralized with a spray from a spray ring or from nozzles in a scrubber.

SUMMARY OF THE INVENTION

A waste disposal system constructed in accordance with the present invention includes a reactor vessel containing a plasma arc burner. The interior walls of the reactor vessel are lined with carbon-graphite, which is impregnated with neutralizing compounds and elements. Waste material introduced into the vessel is atomized and ionized into pyrolytic products by the plasma arc burner. Then impregnated carbon from the graphite liner combines with, and neutralizes, the pyrolytic products to form non-toxic, non-hazardous gases and particulate.

One object of the present invention is to provide a waste disposal system which efficiently transforms toxic, hazardous and medical wastes as well as poison gas streams into non-toxic, non-hazardous and recyclable products.

Another object of the present invention is to provide a waste disposal system which destroys both solid and fluid waste material.

Yet another object of the present invention is to provide a waste disposal system which may be constructed as a small, mobile apparatus.

Still another object of the present invention is to provide a waste disposal system which is a closed-loop system and which does not release any harmful emissions to the environment.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
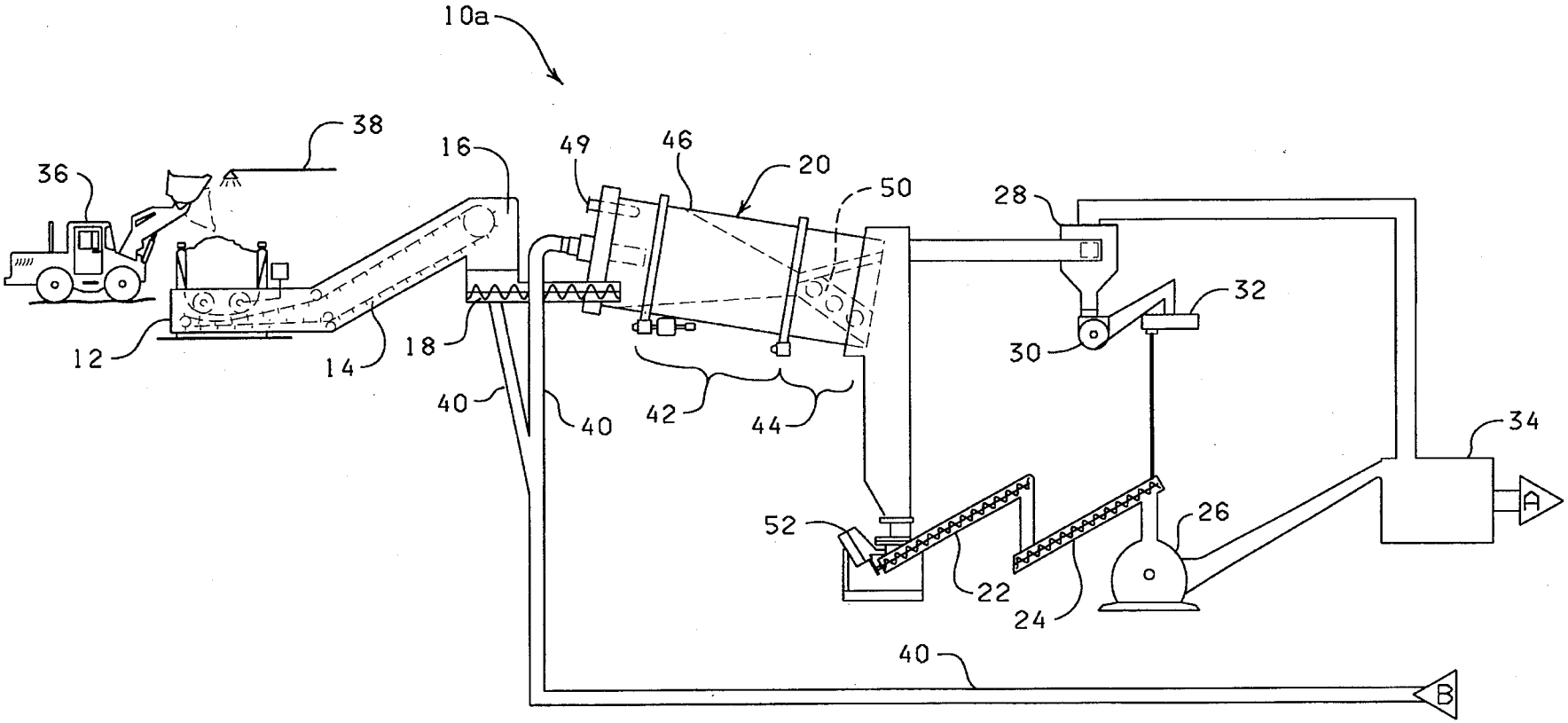
FIG. 1 is a diagram of a first portion of a waste disposal plant constructed in accordance with the present invention.

Referring to the drawings in general, and to FIG. 1 in particular, shown therein and designated by the general reference numeral 10*a* is a first portion of a waste disposal plant, which includes a live bottom hopper 12, a drag conveyor 14, a feed bin 16, a feed auger 18, a plasma scission reactor 20, a pair of ash augers 22 and 24, an ash blower 26, a cyclone separator 28, a cyclone ash blower 30, a cyclone pulverizer 32 and an ash pulverizer 34.

Loading equipment such as a front-end loader 36 may be used to deposit some types of waste material into the live bottom hopper 12. A dust suppression spray system 38 may be provided to prevent waste material dust from escaping the hopper 12.

For other types of waste, it may be appropriate to provide a rotary air lock or the like to contain the waste material. Further, it may be desirable to provide suitable material shredders or screens for size reduction and separation of the waste material before introducing the waste material into the scission reactor 20.

The drag conveyor 14 transfers waste material from the live bottom hopper 12 to the feed bin 16. In turn, the feed auger 18 carries waste material out of the feed bin 16 and into the plasma scission reactor 20. Insulated ducts 40 may be provided to supply hot gases to the feed bin 16, the feed auger 18 and the plasma scission reactor 20 for preheating the waste material.

The plasma scission reactor 20 has a first section 42 and a second section 44. The first section 42 of the plasma scission reactor 20 includes a rotatable drum 46 which receives waste material and funnels the waste material into the second section 44 of the plasma scission reactor 20. A drive motor 48 or any suitable, conventional apparatus may be provided to rotate the drum 46 of the plasma scission reactor 20.

A liquid injection port 49 is provided for introduction of liquid waste into the first section 42 of the plasma scission reactor 20.

The second section 44 of the scission reactor 20 comprises a plasma/electric arc apparatus 50, which is described in detail hereinafter. The plasma/electric arc apparatus 50 receives waste material from the first section 42 of the scission reactor 20 and pyrolyzes the waste material into gases and ash.

Heavier ash may travel to the pair of ash augers 22 and 24. An auxiliary ash blower 52 may be provided to urge the heavier ash into the ash augers 22 and 24.

Lighter ash remains entrained in the hot gas stream and is carried into the cyclone separator 28, where the gases and ash are separated. The ash is forced by the cylcone ash blower 30 into the cyclone pulverizer 32. Then the cyclone ash travels to the primary ash blower 26 and is combined with the ash from the ash augers 22 and 24.

The hot gases from the cyclone separator 28 and the combined ash are then fed through the primary ash pulverizer 34 before being introduced into a second portion 10*b* of the waste disposal system.

Figure 2:
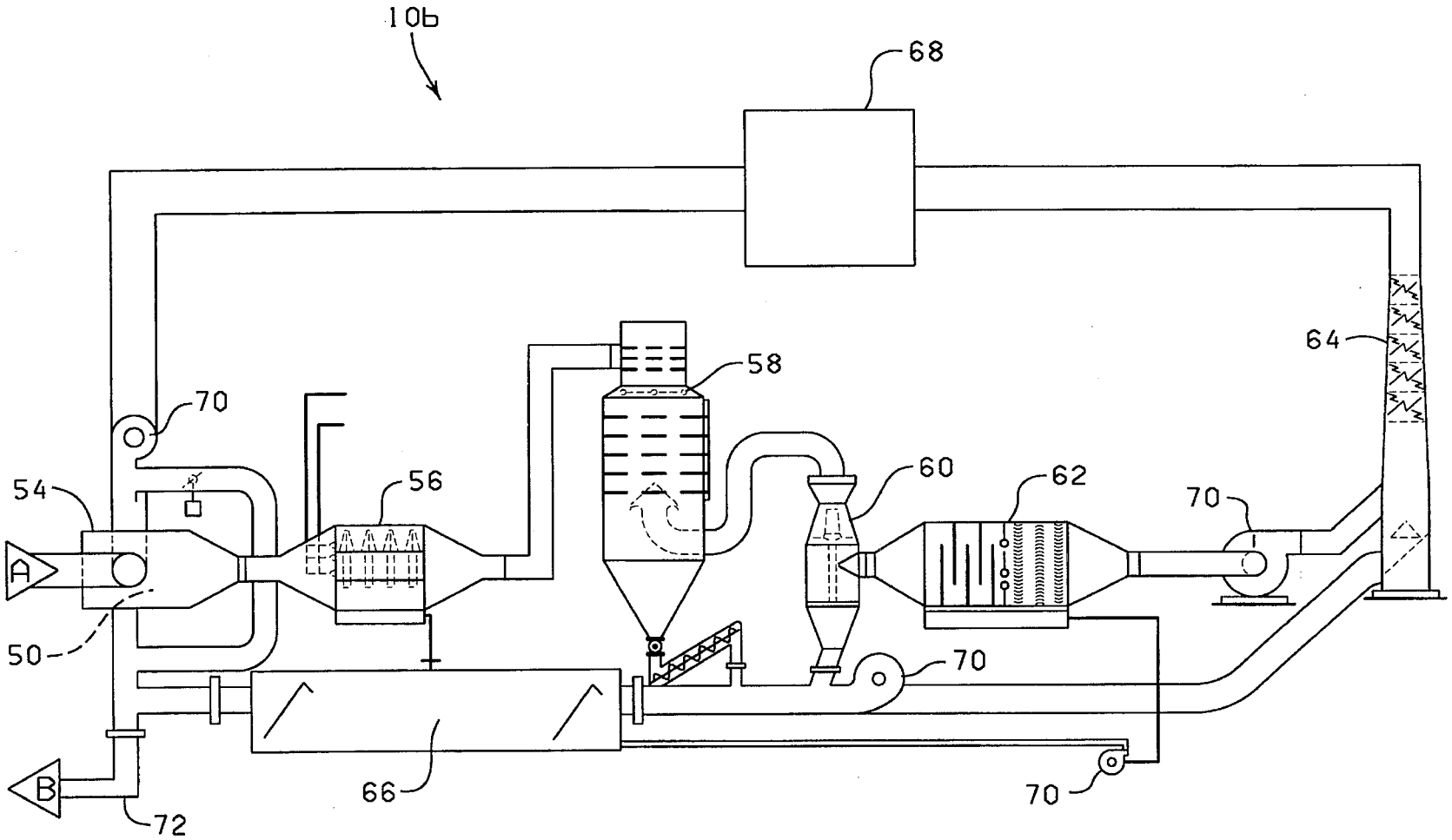
FIG. 2 is a diagram of a second portion of a waste disposal plant constructed in accordance with the present invention.

Referring to FIG. 2, the second portion 10*b* of the plant comprises a chemical scission reactor 54, a second cyclone separator 56, a magnetic separator 58, a third cyclone separator 60 a horizontal baffle separator 62, a hydrostatic tower separator 64, an ash classifier 66 and an electric cogeneration system 68. Blowers 70 are provided to move ash and gases through the second portion 10*b* of the waste disposal plant.

The combined ash and gases from the first portion 10*a* of the plant are introduced into the chemical scission reactor 54, which comprises a second plasma/electric arc apparatus 50. Within the chemical scission reactor 54, the waste material is completely broken down into free atoms and ions. Then carbon, neutralizing agents and oxygen and/or hydrogen are provided to the free waste atoms for recombination into non-toxic, non-hazardous and recyclable compounds.

Supercritical water, that is, water under sufficient pressure and temperature to cause it to be atomized as it enters the chemical scission reactor 54, may be introduced into the chemical scission reactor 54 to supply a source of oxygen and hydrogen atoms.

The products from the chemical scission reactor 54 are fed through the cyclone separator 56, the magnetic separator 58, the separators 60 and 62 and the hydrostatic tower separator 64 to remove ash and any solids from the gases in the products. The ash from the various separators is forced into the ash classifier 66.

After the inert ash elements and compounds have been separated from the hot gases, the hot gases may be provided to the electric cogeneration system 68 for the generation of electricity. The hot gases from the second portion 10*b* of the plant may be supplied to the first portion 10*a* of the plant through duct 72 for preheating waste material.

However, most of the gases are compressed and recycled for use as inert, non-toxic gases. Recombined compounds and elements are collected in the magnetic separator 58 and the ash classifier 66 for recycling.

Figure 3:
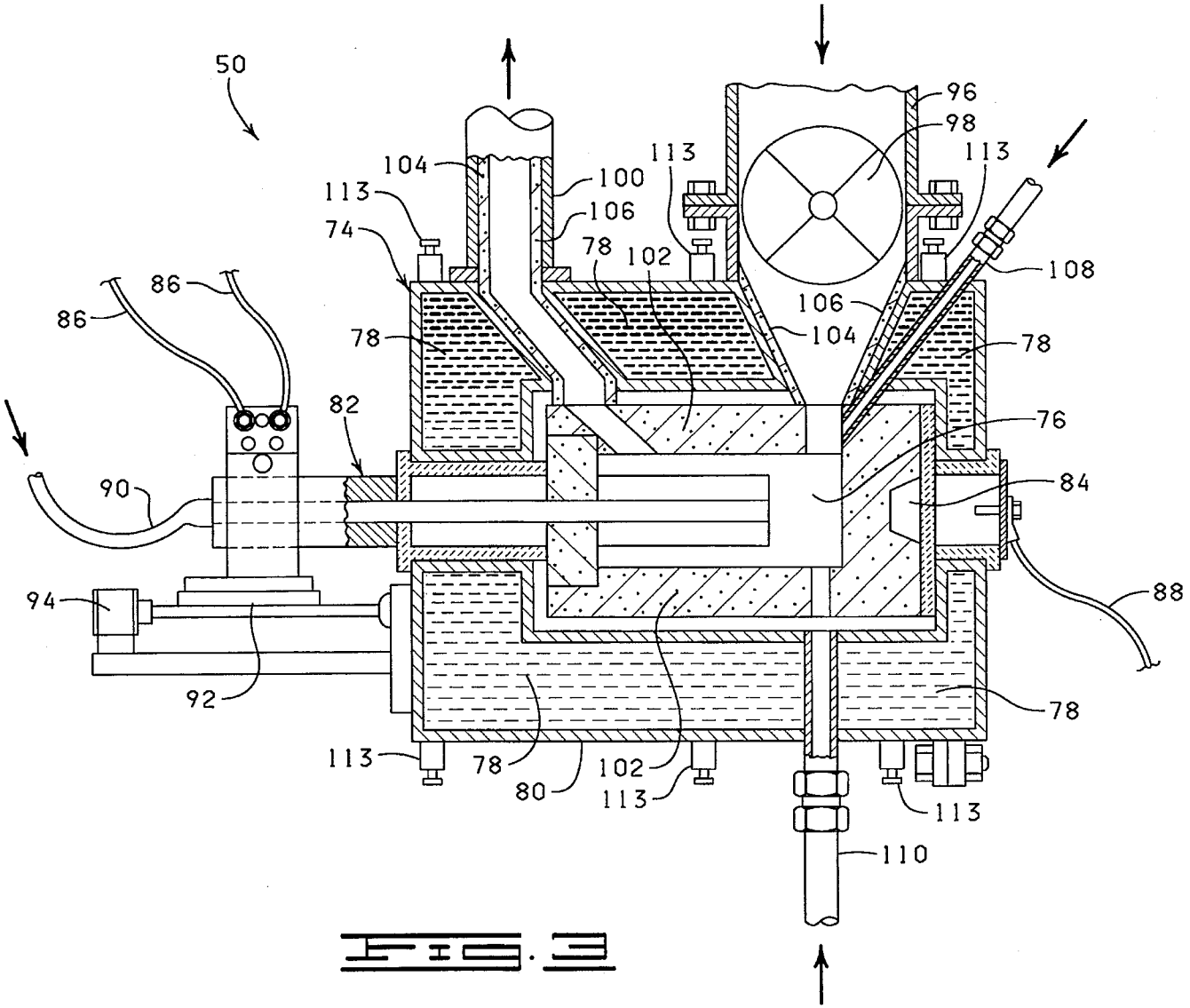
FIG. 3 is a partly sectional, partly diagrammatic view of a plasma arc reactor shown in FIGS. 1 and 2.

With reference to FIG. 3, shown therein is one of the plasma/electric arc apparatus 50, which includes a vessel 74 defining an inner plasma/electric arc chamber 76 surrounded by a jacket chamber 78. Water or any suitable cooling fluid is circulated through the jacket chamber 78 to provide a buffer between the walls of the plasma/electric arc chamber 76 and the outer walls 80 of the vessel 74. Typically, the outer walls 80 of the vessel 74 are constructed of carbon steel, stainless steel, or the like.

A tubular plasma electrode 82 is mounted outside the vessel 74 and extends in a reciprocating manner into the plasma/electric arc chamber 76. A complementary electrode 84 extends into the plasma/electric arc chamber 76 opposite the tubular plasma electrode 82. Suitable electrical connections 86 and 88 with an electrical power source are made to the two electrodes 82 and 84, respectively.

The plasma/electric arc may be operated at a wide range of temperatures depending on the type of waste material being processed. A typical operating temperature is about 10,180 degrees Fahrenheit, but the plasma/electric arc may operate at temperatures up to approximately 50,000 degrees Fahrenheit.

It should be appreciated that other devices may be used in place of the plasma/electric arc. For instance, a microwave device or any other conventional heat source capable of supplying sufficient thermal energy may be employed.

An input conduit 90 sealingly communicates with the tubular plasma electrode 82 such that waste material, particularly poison gas or fluid waste material, can be introduced into the plasma/electric arc chamber 76 through the tubular plasma electrode 82. A worm gear 92 with drive motor 94 are provided to adjust the position of the tubular plasma electrode 82 within the plasma/electric arc chamber 76.

It is contemplated that a large tubular electrode 82 may be provided for introducing solid waste material therethrough into the plasma/electric arc chamber 76. It is also intended that a series of electrodes 82 may be used to increase the waste destruction capability of the chemical scission reactor 54.

An input duct 96 communicates with the plasma/electric arc chamber 76 to introduce additional waste material, particularly solid waste material, into the plasma/electric arc chamber 76. A rotary air lock 98 is typically mounted within the input duct 96 to close off the input duct 96 when desired.

An output duct 100 also communicates with the plasma/electric arc chamber 76. Hot gases and ash leave the vessel 74 through the output duct 100 as products of the pyrolysis within the plasma/electric arc chamber 76.

The interior walls of the plasma/electric arc chamber 76 are lined with a carbon-graphite liner 102. Further, the output duct 100 and the lower portion of the input duct 96 are provided with carbon-graphite liners 104 and 106, respectively.

It should be appreciated that the graphite liners 102, 104 and 106 act as sources of carbon atoms to combine with atoms which are produced by the plasma arc atomical decomposition of the waste material into a gaseous form. In this manner, toxic and hazardous waste is atomically converted into carbon-based compounds which are non-toxic and non-hazardous.

In addition, the carbon-graphite liners 102,104 and 106 may be impregnated with neutralizing agents for neutralizing particular types of toxic and hazardous waste material. For example, if the waste material is radioactive, the graphite liners 102, 104 and 106 may be impregnated with boron to neutralize the radioactivity.

If the waste material is acidic, the graphite liners 102, 104 and 106 may be impregnated with a base to neutralize the acid. Conversely, an acidic substance may be imbedded in the graphite liners 102, 104 and 106 as a neutralizing agent for waste material containing bases. In particular, the graphite liners 102, 104 and 106 may be impregnated with lime if the waste material includes polychlorinated biphenols (PCBs).

Neutralizing agents are in no way limited to the examples just mentioned. It should be appreciated that any substance known in the art as a neutralizing agent for a particular waste material may be used to impregnate the liners 102, 104 and 106.

It should also be appreciated that such neutralizing agents may be injected into the plasma/electric arc chamber 76 rather than being imbedded in the graphite liners 102,104 and 106. For this purpose, an injection port 108 is provided.

A second injection port 110 may be provided for injection of water, particularly supercritical water, or hydrogen and/or oxygen. The purpose for this injection is to supply oxygen atoms, hydrogen atoms, or both, to the plasma/electric arc chamber 76 for combining with the atoms from the atomically decomposed waste material.

A magnetic collar 113 may extend around the vessel 74 for applying a magnetic field to the plasma/electric arc chamber 76. Such a magnetic field acts upon the atomized waste material to keep the heat of the plasma in a more concentrated area.

Figure 4:
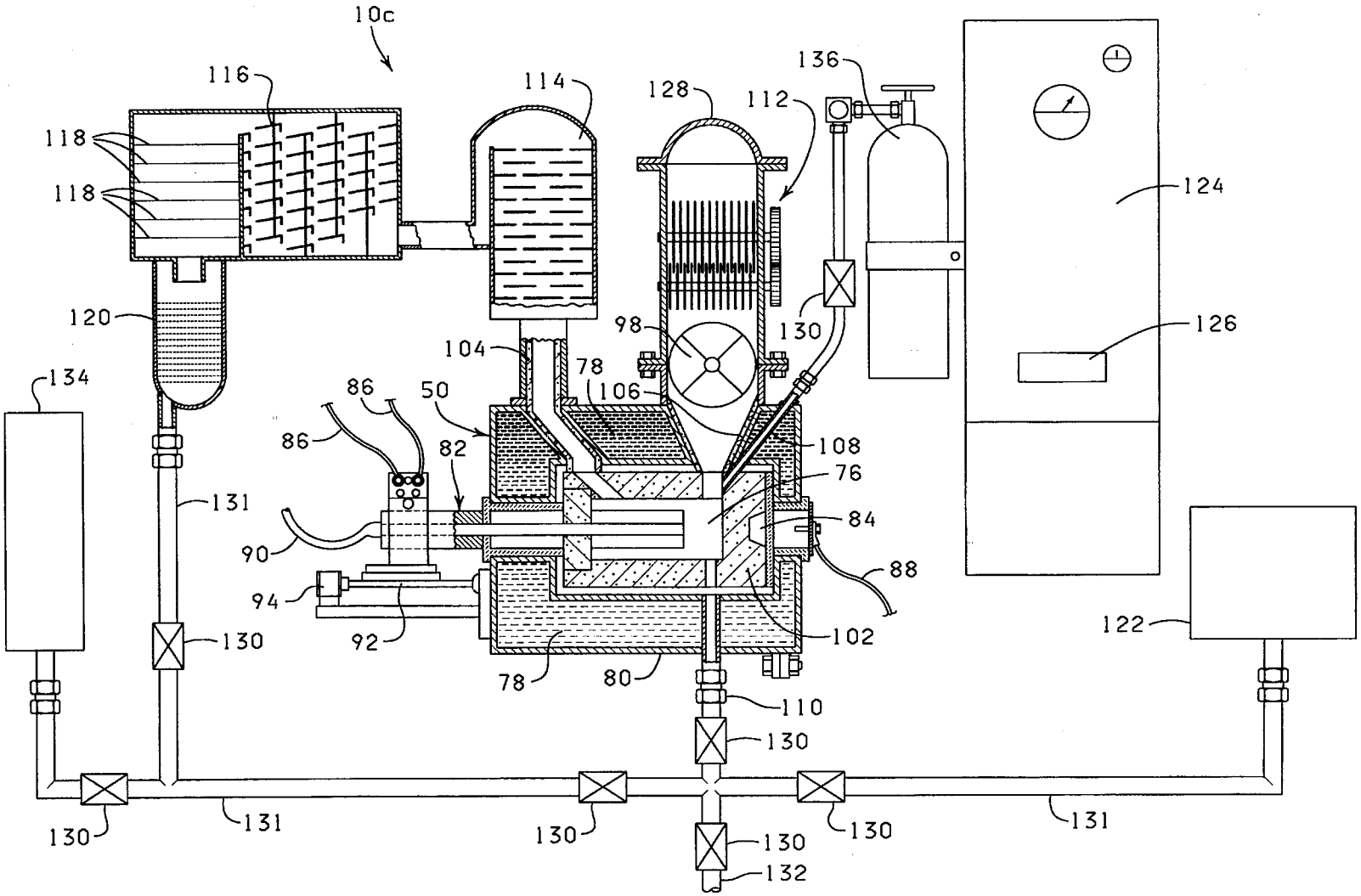
FIG. 4 is a partly sectional, partly diagrammatic view of a medical waste disposal system constructed in accordance with the present invention.

Embodiment of FIG. 4

Referring to FIG. 4, shown therein and designated by reference numeral 10*c* is a system particularly adapted to, but not limited to, the disposal of medical waste. It should be readily apparent that the system 10*c* employs the plasma/electric arc apparatus 50 disclosed hereinabove.

The system 10*c* also includes a shredder 112, a magnetic separator 114, a refrigerator separator 116, a plurality of magnetic trays 118, a micron filter 120, a vacuum pump 122, a rectifier 124 and a process control computer 126.

The shredder 112 has a cover 128 which sealingly latches shut. Waste material, which may include medical waste and "sharps," is deposited into the shredder 112. Then the waste material is introduced through the air lock 98 into the plasma/electric arc chamber 76.

The waste material is atomically decomposed and recomposed into non-waste compounds substantially as described hereinabove. The gases from the plasma/electric arc apparatus 50 travel to the magnetic separator 114, the refrigerator separator 116, the magnetic trays 118 and the micron filter 120.

Ash trapped by the separators 114 and 116, the magnetic trays 118 and the filter 120 may be removed and disposed of or may be re-introduced into the system 10*c* for repeated processing. Gases are drawn through the conduit 131 of the system 10*c* by the vacuum pump 122.

Control valves 130 are provided in conduit 131 for controlling the flow of material through the system 10*c*. One of the control valves 130 may be opened to divert material out an exit pipe 132 of the system 10*c* and into a compressor and into cylinders for containing compressed gases.

The process control computer 126 is operatively connected to appropriate pressure, temperature, position and flow rate sensors to receive operating parameters of the system 10*c*. The computer 126 is also operatively connected to the power rectifier 124, the worm gear drive motor 94 and the control valves 130 to control the operation of the system 10*c*. It should be appreciated that the process control computer 126 functions according to a computer program, which uses information from the various sensors to adjust temperature in the plasma/electric arc chamber 76 and the flow of materials through the conduit 131 and the system 10*c*.

A reservoir of cleaning solution 134 may be connected to the conduit 131 of the system 10*c*. By introducing a suitable cleaning agent into the conduit 131, the components of the system 10*c* may be cleaned to reduce maintenance and enhance the performance of the system 10*c*.

A cylinder 136 containing hydrogen or oxygen may be provided to supply hydrogen or oxygen atoms to the plasma/electric arc chamber 76. As disclosed hereinabove, carbon atoms from the graphite liners 102, 104 and 106, and hydrogen and/or oxygen atoms from the cylinder 136 bond with the atoms resulting from the thermal decomposition of the waste material. The new compounds produced by this chemical bonding are non-hazardous and even useful materials which can be recycled.

Figure 5:
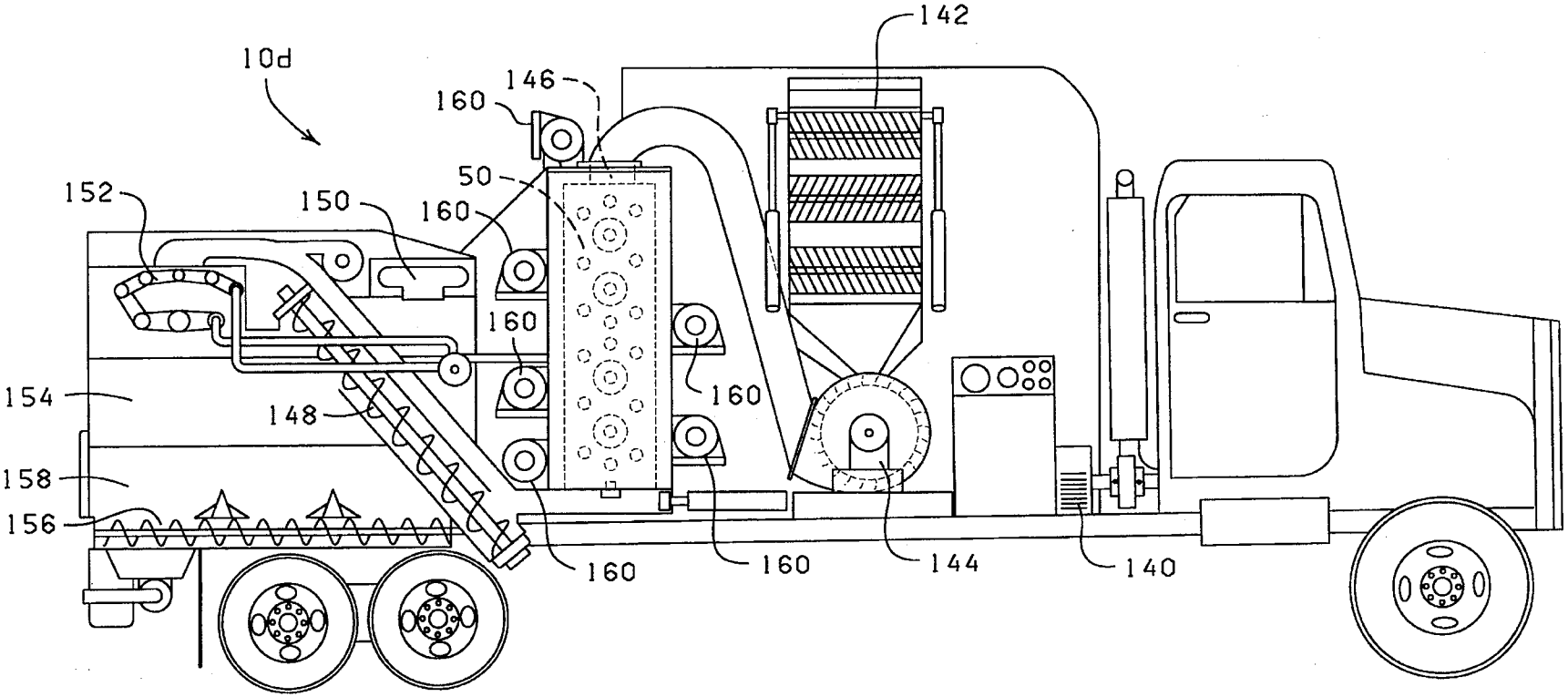
FIG. 5 is a partly diagrammatical side view of a mobile waste disposal system constructed in accordance with the present invention.

Embodiment of FIG. 5

With reference to FIG. 5, shown therein and designated by reference numeral 10*d* is a mobile waste disposal system embodying the plasma/electric arc apparatus 50. The system 10*d* is truck-mounted and includes a generator 140, a shredder 142, an impeller 144, a housing 146 containing the plasma/electric arc apparatus 50, a transfer auger 148, scrubbers 150, cooling coils 152, an ash bin 154, a discharge auger 156 and a water reservoir 158.

Waste material is deposited into the upper end of the shredder 142 and the impeller 144 forces shredded waste into the plasma/electric arc apparatus 50. Blowers or vacuum pumps 160 and the transfer auger 148 urge gases and ash from the plasma/electric arc apparatus 50 into the scrubbers 150.

The scrubbers 150 separate ash from the gases and the cooling coils 152 cool the hot ash before the ash is deposited into the ash bin 154. The discharge auger 156 is provided for removal of ash from the ash bin 154.

The water reservoir 158 provides a supply of water for circulation through the water jacket chamber 78 of the plasma/electric arc apparatus 50. It should be appreciated that conventional piping, connections, pumps, controls and other components are assembled in any manner known in the art to perform the intended function of the mobile waste disposal system 10*d*.

It should be appreciated that the present invention may be utilized to destroy a wide variety of waste materials. For example, the present invention may be adapted for use with automobiles and other devices having exhaust-producing engines to convert harmful exhausts into useful compounds.

Changes may be made in the combinations, operations and arrangements of the various parts and elements described herein without departing from the spirit and scope of the invention as defined in the following claims.

What is claimed is:

1. An apparatus for thermal decomposition of waste materials, the apparatus comprising:

a vessel having an interior wall defining a chamber within the vessel;

a carbon source disposed within the chamber of the vessel;

means for introducing waste materials into the chamber of the vessel; and means, located within the chamber of the vessel, for thermally scissioning waste materials within the chamber of the vessel into waste material atoms, and for thermally scissioning at least a portion of the carbon source into carbon atoms;

wherein the waste material atoms are commingled with the carbon atoms in the chamber of the vessel to be recombined into non-waste compounds, and wherein the carbon source is impregnated with a substance for neutralizing the waste materials.

2. The apparatus of claim 1 wherein the carbon source comprises a graphite liner covering at least a portion of the interior wall of the vessel.

3. The apparatus of claim 1 further comprising:

means for shredding waste material before the waste material is introduced into the chamber of the vessel.

4. The apparatus of claim 1 wherein the vessel further comprises:

an outer wall defining an annulus between the chamber and the outer wall of the vessel; and means for circulating a cooling fluid through the annulus of the vessel.

5. The apparatus of claim 1 further comprising:

means for introducing a substance for neutralizing the waste materials in the chamber of the vessel.

6. The apparatus of claim 1 further comprising:

means for introducing water into the chamber of the vessel to commingle hydrogen and oxygen atoms with the waste material atoms and carbon atoms.

7. The apparatus of claim 6 wherein the means for introducing water into the chamber of the vessel is further characterized as introducing water under heat and pressure.

8. The apparatus of claim 1 further comprising: p1 means for removing gases and particulate from the chamber of the vessel.

9. The apparatus of claim 8 further comprising:

means for separating the gases and particulate removed from the chamber of the vessel.

10. The apparatus of claim 1 further comprising:

a vehicle carrying the vessel such that the apparatus is mobile.

11. The apparatus of claim 1 wherein the means for thermally scissioning waste material further comprises:

a tubular electrode extending into the chamber of the vessel.

12. The apparatus of claim 1 further comprising:

means for adjusting the position of the tubular electrode within the chamber of the vessel.

13. The apparatus of claim 11 further comprising:

means for introducing waste material through the tubular electrode into the chamber of the vessel.

14. The apparatus of claim 1 further comprising:

magnetic means for separating metals from the waste materials.

15. A method for disposing of hazardous waste material, the steps of the method comprising:

providing a vessel having a chamber with an inner graphite liner and a plasma arc within the chamber;

impregnating the graphite liner with a substance for neutralizing the waste material; and introducing waste material into the chamber of the vessel such that the plasma arc atomically decomposes the waste material into gases and ash;

wherein carbon from the graphite liner combines with the gases and ash to form non-hazardous materials.

16. The method of claim 15 further comprising:

injecting a substance for neutralizing the waste material into the chamber of the vessel.

17. The method of claim 15 further comprising:

injecting water into the chamber of the vessel.

18. The method of claim 15 further comprising:

providing a tubular electrode extending into the chamber of the vessel; and introducing waste material into the chamber of the vessel through the tubular electrode.

19. The method of claim 15 further comprising:

removing gases and ash from the chamber of the vessel; and separating the ash from the gases.

20. The method of claim 15 further comprising:

magnetically separating metals from the gases and ash.

* * * * *